US007222416B2

(12) United States Patent
Baba et al.

(10) Patent No.: US 7,222,416 B2
(45) Date of Patent: May 29, 2007

(54) EDGE BENDING APPARATUS

(75) Inventors: Kousei Baba, Sayama (JP); Toshiyuki Usui, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 746 days.

(21) Appl. No.: 10/432,569

(22) PCT Filed: Nov. 19, 2001

(86) PCT No.: PCT/JP01/10073

§ 371 (c)(1),
(2), (4) Date: Oct. 23, 2003

(87) PCT Pub. No.: WO02/42019

PCT Pub. Date: May 30, 2002

(65) Prior Publication Data

US 2006/0201230 A1 Sep. 14, 2006

(30) Foreign Application Priority Data

Nov. 24, 2000 (JP) ..... 2000-357241

(51) Int. Cl.
*B23P 19/00* (2006.01)
*B23P 11/00* (2006.01)
*B21D 39/00* (2006.01)

(52) U.S. Cl. ..... 29/796; 29/509; 72/405.07

(58) Field of Classification Search ..... 29/796, 29/822, 514, 509, 795, 243.5, 243.57, 243.58; 72/404, 404.01, 405.07, 405.05
See application file for complete search history.

(56) References Cited

U.S. PATENT DOCUMENTS 4,346,579 A * 8/1982 Takatsu ..... 72/314
5,148,697 A * 9/1992 Shiraishi et al. ..... 72/405.1
5,150,508 A * 9/1992 St. Denis ..... 29/463
5,170,558 A * 12/1992 Hubbard ..... 29/897.31
5,363,683 A * 11/1994 Thudium et al. ..... 72/405.1
5,388,952 A * 2/1995 Hofele et al. ..... 198/375
5,584,205 A * 12/1996 Harsch et al. ..... 72/405.02
5,865,058 A * 2/1999 VanderZee et al. ..... 72/405.1
6,112,390 A * 9/2000 Takeda et al. ..... 29/33 K
6,125,683 A 10/2000 Toeniskoetter ..... 74/426
6,446,478 B1 * 9/2002 Muller ..... 72/306

(Continued)

FOREIGN PATENT DOCUMENTS

DE 19830944 1/2000

(Continued)

*Primary Examiner*—David P. Bryant
*Assistant Examiner*—Christopher M. Koehler
(74) *Attorney, Agent, or Firm*—Standley Law Group LLP

(57) ABSTRACT

A first hemming mold unit (20) and a second hemming mold unit (30), are installed in a single pressing machine. The first hemming mold unit (20) performs partial bending of an edge (95) of a workpiece (93; 96). The workpiece (93; 96), having undergone the partial bending, is transferred to the second hemming mold unit (30), the second hemming mold unit (30) performs remaining necessary bending of the edge of the workpiece (93; 96). Here, predetermined bending of the edge (95) of the workpiece (93; 96) can be completed within the single pressing machine only by downward movement of upper molds (24, 34) of the first and second hemming mold units (20, 30), without having to use a cam and cam driver.

2 Claims, 15 Drawing Sheets

U.S. PATENT DOCUMENTS

| | | | | |
|---|---|---|---|---|
| 6,612,146 | B2 * | 9/2003 | Saint Denis et al. | 72/306 |
| 6,712,198 | B2 * | 3/2004 | Harsch et al. | 198/750.11 |
| 7,082,803 | B2 * | 8/2006 | Hario et al. | 72/306 |
| 7,124,491 | B2 * | 10/2006 | Toeniskoetter et al. | 29/434 |
| 2002/0170333 | A1 * | 11/2002 | Saint Denis et al. | 72/312 |
| 2004/0107559 | A1 * | 6/2004 | Toeniskoetter et al. | 29/509 |

FOREIGN PATENT DOCUMENTS

| | | | |
|---|---|---|---|
| EP | 0 732 161 | A2 | 9/1996 |
| JP | 03-216219 | A | 9/1991 |
| JP | 4-134225 | | 5/1992 |
| JP | 04-157028 | A | 5/1992 |
| JP | 4351227 | A | 12/1992 |

* cited by examiner

EDGE BENDING APPARATUS

TECHNICAL FIELD

The present invention relates an edge bending technique suitable for use in manufacture of vehicle hoods.

BACKGROUND ART

Edge bending is an essential technique for the manufacture of automobiles, particularly their bonnets or hoods. A typical example of such hoods is shown in top plan in FIG. 14 hereof. The example hood has a cross section as shown in FIG. 15 hereof.

As shown in FIG. 14, the hood 100 includes a stiffener member 101 covered with a skin member 102, and edges of the skin member 102 are folded back around edges of the stiffener member 101 so that the skin member 102 and stiffener member 101 are secured with each other into an integral unit.

Discussion will be made next as to typical steps in a conventional method of manufacture of the hood 100 with reference to (a) to (c) of FIG. 16 hereof.

In a first step shown in section (a) of FIG. 16, there are first provided a skin member 102 having been formed by bending or drawing a blank into a predetermined shape and then bending edges 103 and 104 about 90 degrees, and a stiffener member 101 similarly formed by bending or drawing. Then, the stiffener 101 turned upside down is placed on the skin member 102 also held upside down.

In the next step shown in section (b) of FIG. 16, the edges 103 and 104 of the skin member 102 are bent inwardly; the edge bending is also called "hemming".

Section (c) of FIG. 16 shows the hood 100 having undergone the edge bending or hemming operations. Turning this hood 100 upside down can provide the hood 100 of FIG. 15.

As examples of the hemming technique, there are known an "entire-peripheral-edge bending apparatus" disclosed in Japanese Utility Model Laid-Open Publication No. HEI-4-134225 (① publication) and an "entire-peripheral-edge hemming method for a panel having a line" disclosed in Japanese Patent Laid-Open Publication No. HEI-4-351227 (② publication).

In FIG. 3 of the ① publication, a peripheral flange portion 2*a* (the same reference numerals as appearing in the above-mentioned publications are used here for convenience of description of the background art) is bent, by a pre-hemming punch 18 movable in a left-and-right direction of the figure, to cover an end edge portion 3*a*.

In the ② publication, as shown in FIGS. 3 to 5 thereof, a pre-hemming punch 9 is pivotally mounted on a pivot shaft 11, and a flange portion 2*a* of an outer panel is bent by moving a cam-driver punch 15 downward to thereby cause the pre-hemming punch 9 to pivot about the pivot shaft 11.

With the hemming technique disclosed in the ① publication, there has to be provided a means for pushing the pre-hemming punch 18 in the horizontal direction. Generally, the pushing means converts a vertical operating force of a cam-driver punch moving downward, similarly to the cam-driver punch 15 in the ② publication, into a horizontal force via a pivot member and cam.

However, as evident from FIG. 4 in the ② publication, the operating force conversion requires a plurality of intermediary component parts. Further, with the hemming technique disclosed in the ② publication, the pivot shaft 11 wears with long time use, as a result of which too much looseness or play would be produced between the component parts. Thus, the pre-hemming punch 9 tends to be positioned inaccurately, which would adversely affect the finishing accuracy of products.

DISCLOSURE OF THE INVENTION

In view of the foregoing, it is an object of the present invention to provide a technique which permits accurate hemming without using a cam and cam driver.

To accomplish the above object, the present invention provides an edge bending method which comprises the steps of: installing a first hemming mold unit and a second hemming mold unit in a single pressing machine in parallel; causing the first hemming mold unit to perform partial bending of an edge of a workpiece; transferring the workpiece, having undergone the partial bending, to the second hemming mold unit thorough a first workpiece transfer section and a second workpiece transfer section; and causing the second hemming mold unit to perform remaining bending of the edge of the workpiece, whereby predetermined bending of the edge of the workpiece is completed within the single pressing machine.

The necessary bending of the workpiece edge is performed only by downward movement of upper molds. To achieve this, the edge bending of the workpiece is performed through at least two bending stages, the initial bending stage by the first hemming mold unit and the second bending stage by the second hemming mold unit. In this way, the necessary edge bending is carried out step by step via the plurality of hemming mold units.

According to the present invention, the workpiece is placed directly on the upper molds with no intervening cam and cam driver. Thus, there is no need to worry about occurrence of undue looseness or play between the elements, and it is possible to maintain a good finishing accuracy of products over a long period of time.

In addition, because no intervening cam and cam driver is employed, the edge bending apparatus can be greatly simplified in construction.

The present invention also provides an edge bending apparatus which comprises: a first hemming mold unit for bending an edge of a workpiece halfway through a predetermined full bending angle; and a second hemming mold unit for further bending the edge of the workpiece from the halfway angle to the predetermined full bending angle, the first hemming mold unit and the second hemming mold unit being installed in a same pressing machine in parallel.

The necessary bending of the workpiece edge is performed only by downward movement of upper molds. To achieve this, the edge bending of the workpiece is performed through at least two bending stages, the initial bending stage by the first hemming mold unit and the second bending stage by the second hemming mold unit. In this way, the necessary edge bending is carried out step by step via the plurality of hemming mold units.

According to the present invention, the workpiece is placed directly on the upper molds with no intervening cam and cam driver. Thus, there is no need to worry about occurrence of undue looseness or play between the elements, and it is possible to maintain a good finishing accuracy of products over a long period of time.

In addition, because no intervening cam and cam driver is employed, the edge bending apparatus can be greatly simplified in construction.

The edge bending apparatus of the invention may further comprise: a first workpiece transfer section movable upward and downward through a lower mold of the first hemming mold unit for placing a workpiece on the first hemming mold unit or feeding a workpiece to the first hemming mold unit; a second workpiece transfer section movable upward and downward through a lower mold of the second hemming mold unit for placing the workpiece on the second hemming mold unit or feeding the workpiece to the second hemming mold unit; and an intermediate workpiece transfer section disposed between the first workpiece transfer section and the second workpiece transfer section for supporting thereon the workpiece to be transferred horizontally from the first workpiece transfer section to the second workpiece transfer section.

In the present invention, horizontal transfer of the workpiece within the single pressing machine is absolutely essential. Thus, there are provided the first, second and intermediate workpiece transfer sections for effecting the horizontal transfer of the workpiece.

Further, in the present invention, the first, second and intermediate workpiece transfer sections each include rollers provided to project above an upper surface thereof in such a manner that the workpiece can be easily transferred horizontally on the rollers through manual operation by a human operator.

Although the first, second and intermediate workpiece transfer sections may be driven using a motor or cylinder as a driving source to horizontally transfer the workpiece, the present invention is arranged to horizontally transfer the workpiece by placing the workpiece on the rollers, provided to project above the upper surface of the workpiece transfer sections, so that the workpiece can be easily transferred manually by a human operator. Thus, the first, second and intermediate workpiece transfer sections can be considerably reduced in size and cost.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

Now, a detailed description will be made about embodiments of the present invention, with reference to the accompanying drawings.

Figure 1:
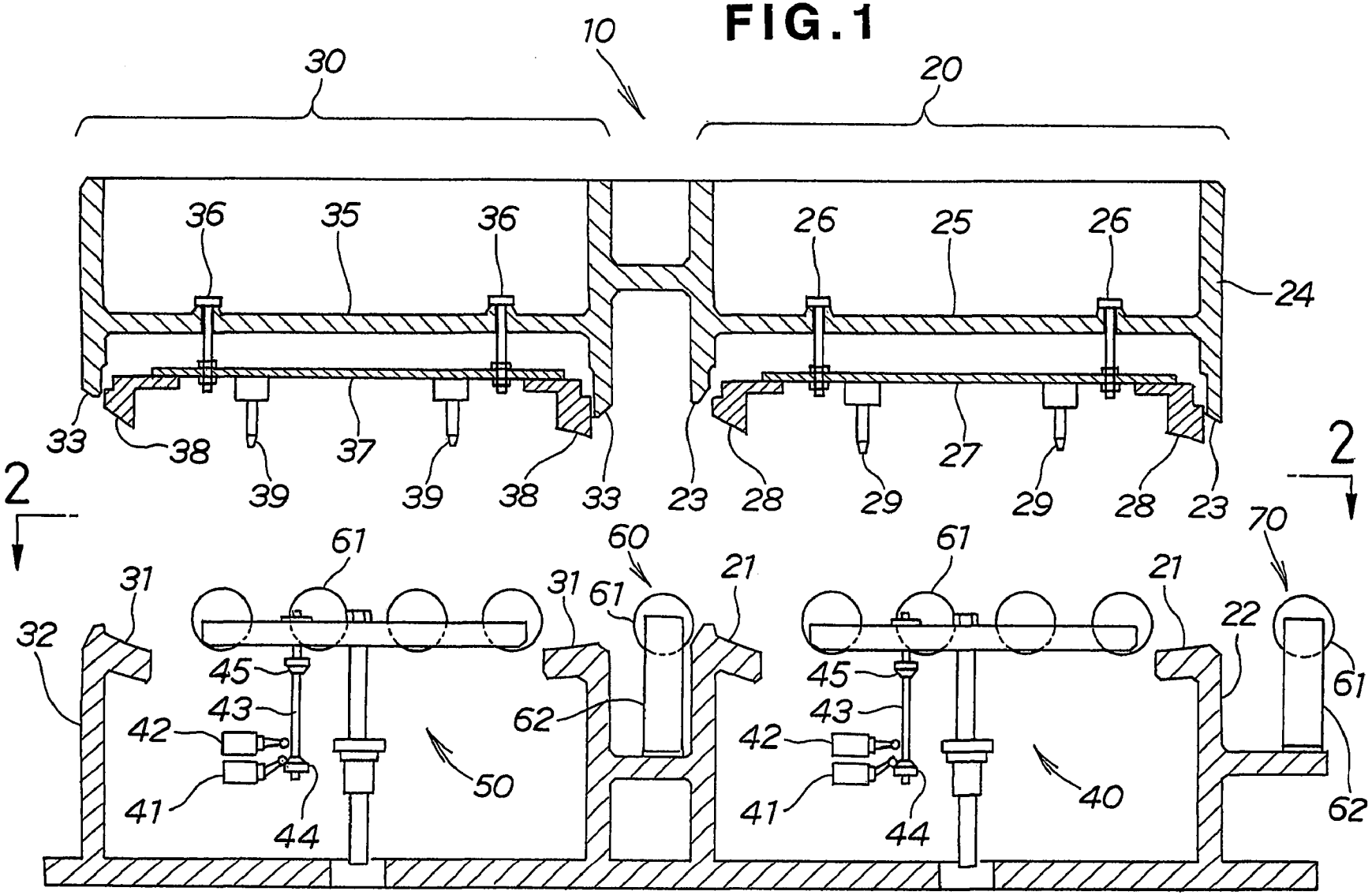
FIG. 1 is a sectional view of an edge bending apparatus in accordance with the present invention.

FIG. 1 is a sectional view of an edge bending apparatus in accordance with the present invention. The edge bending apparatus 10 generally comprises first and second hemming mold units 20 and 30 integrally connected with each other in a left-and-right (horizontal) direction of the figure. Specifically, the first hemming mold unit 20 includes a first lower mold 22 having a peripheral support surface 21 for supporting thereon a peripheral edge of a workpiece (not shown in the figure), and a first upper mold 24 vertically movable toward and away from the first lower mold 22 and having a bending blade 23 for bending the peripheral edge of the workpiece to halfway through a predetermined full bending angle. The first hemming mold unit 20 also includes a hanging frame 27 attached, via bolts 26, to a cross beam 25 of the first upper mold 24 in such a manner that the hanging frame 27 can move vertically relative to the cross beam 25, workpiece retainers 28 fixed to the hanging frame 27, and positioning pins 29.

Similarly, the second hemming mold unit 30 includes a second lower mold 32 having a peripheral support surface 31 for supporting thereon the peripheral edge of the workpiece, and a second upper mold 34 vertically movable toward and away from the second lower mold 32 and having a bending blade 33 for further bending the peripheral edge of the workpiece from the halfway angle to the predetermined full bending angle. The second hemming mold unit 30 also includes a hanging frame 37 attached, via bolts 36, to a cross beam 35 of the second upper mold 34 in such a manner that the hanging frame 37 can move vertically relative to the cross beam 35, workpiece holders 38 fixed to the hanging frame 37, and positioning pins 39.

The first lower mold 22 has a central space, in which are accommodated a first workpiece transfer section 40 (to be later described in detail in relation to FIG. 4), and a combination of upper and lower level switches 41 and 42 and level sensing rod 43 for monitoring a level of the first workpiece transfer section 40. When a first lateral projection 44 on the level sensing rod 43 contacts the upper level switch 41, it can be seen that the first workpiece transfer section 40 is currently at an upper level, i.e. a position for lifting up the workpiece off the first lower mold 22. Further, when a second lateral projection 45 on the level sensing rod 43 contacts the lower level switch 42, it can be seen that the first workpiece transfer section 40 is currently at a lower level, i.e. a standby position.

Similarly, the second lower mold 32 has a central space, in which are accommodated a second workpiece transfer section 50, and a combination of upper and lower level switches 41 and 42 and level sensing rod 43 for monitoring a level of the second workpiece transfer section 50. When a first lateral projection 44 on the level sensing rod 43 contacts the upper level switch 41, it can be seen that the second workpiece transfer section 50 is currently at an upper level, i.e. a position for lifting up the workpiece off the second lower mold 32. Further, when a second lateral projection 45 on the level sensing rod 43 contacts the lower level switch 42, it can be seen that the second workpiece transfer section 50 is currently at a lower level, i.e. a standby position.

That is, the second workpiece transfer section 50 is constructed similarly to the first workpiece transfer section 40.

In addition, the edge bending apparatus 10 includes an intermediate workpiece transfer section 60 disposed between the first and second lower molds 22 and 32, and this intermediate workpiece transfer section 60 includes rollers 61 and a bracket 62 rotatably supporting thereon the rollers 61.

The edge bending apparatus 10 further includes a front workpiece transfer section 70 disposed forward of (in the figure, to the right of) the first lower mold 22 (remotely from the second lower mold 32), and this front workpiece transfer section 70 includes rollers 61 and a bracket 62 rotatably supporting thereon the rollers 61.

Figure 2:
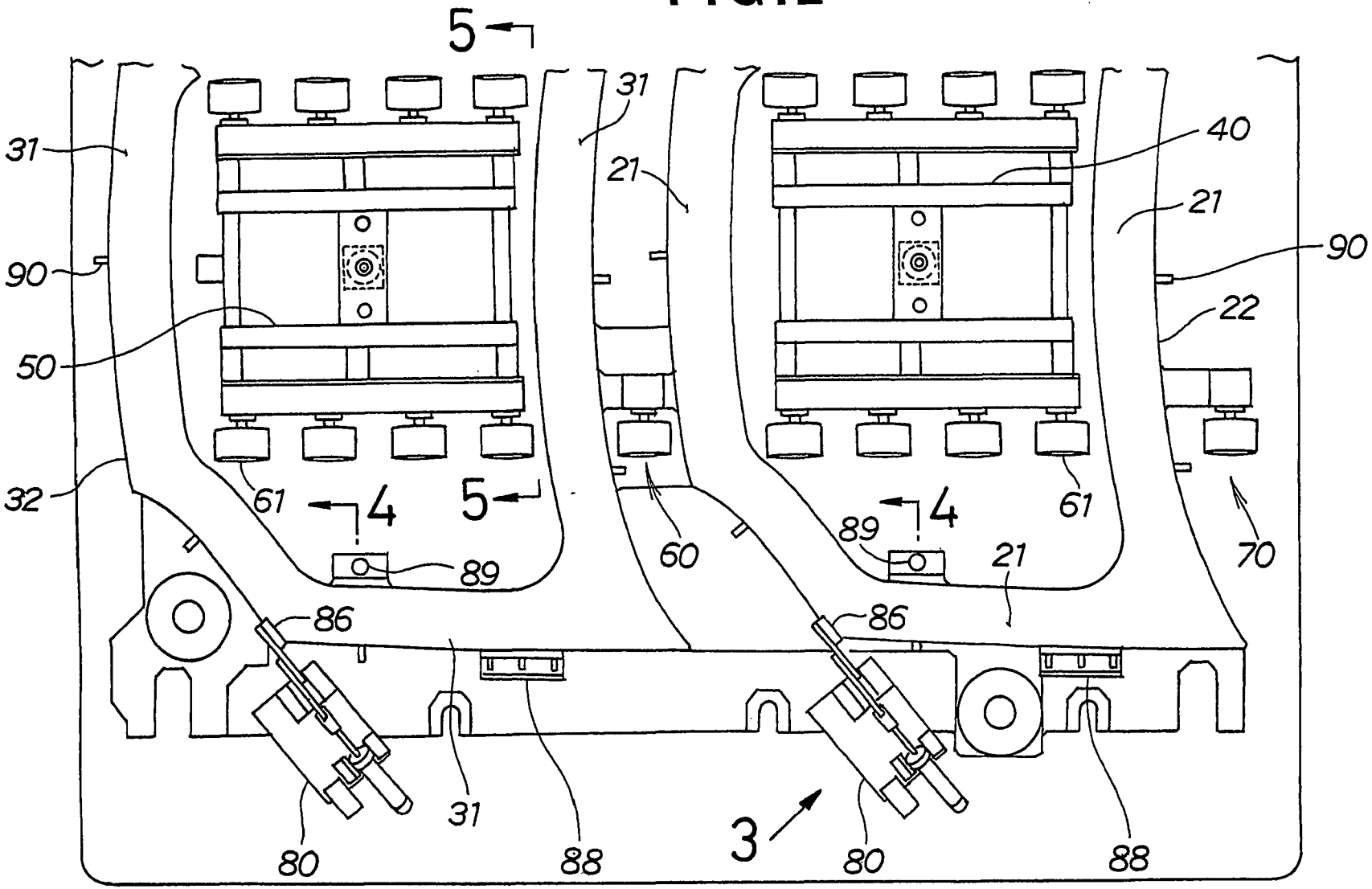
FIG. 2 is a view seen in a direction of a 2—2 arrow of FIG. 1.

FIG. 2 is a view of the edge bending apparatus 10 seen in a direction of the 2—2 arrow of FIG. 1. The first workpiece transfer section 40 is accommodated in the central space of the first lower mold 22 having the peripheral support surface 21, and similarly the second workpiece transfer section 50 is accommodated in the central space of the second lower mold 32 having the peripheral support surface 31. The front workpiece transfer section 70 and intermediate workpiece transfer section 60 are disposed forward and rearward of the first lower mold 22.

Further, on each of the first and second lower molds 22 and 32, there are provided a workpiece stopper 80 generally in the shape of a crossing gate, a workpiece detecting sensor 89, and a workpiece guide 88.

Figure 3:
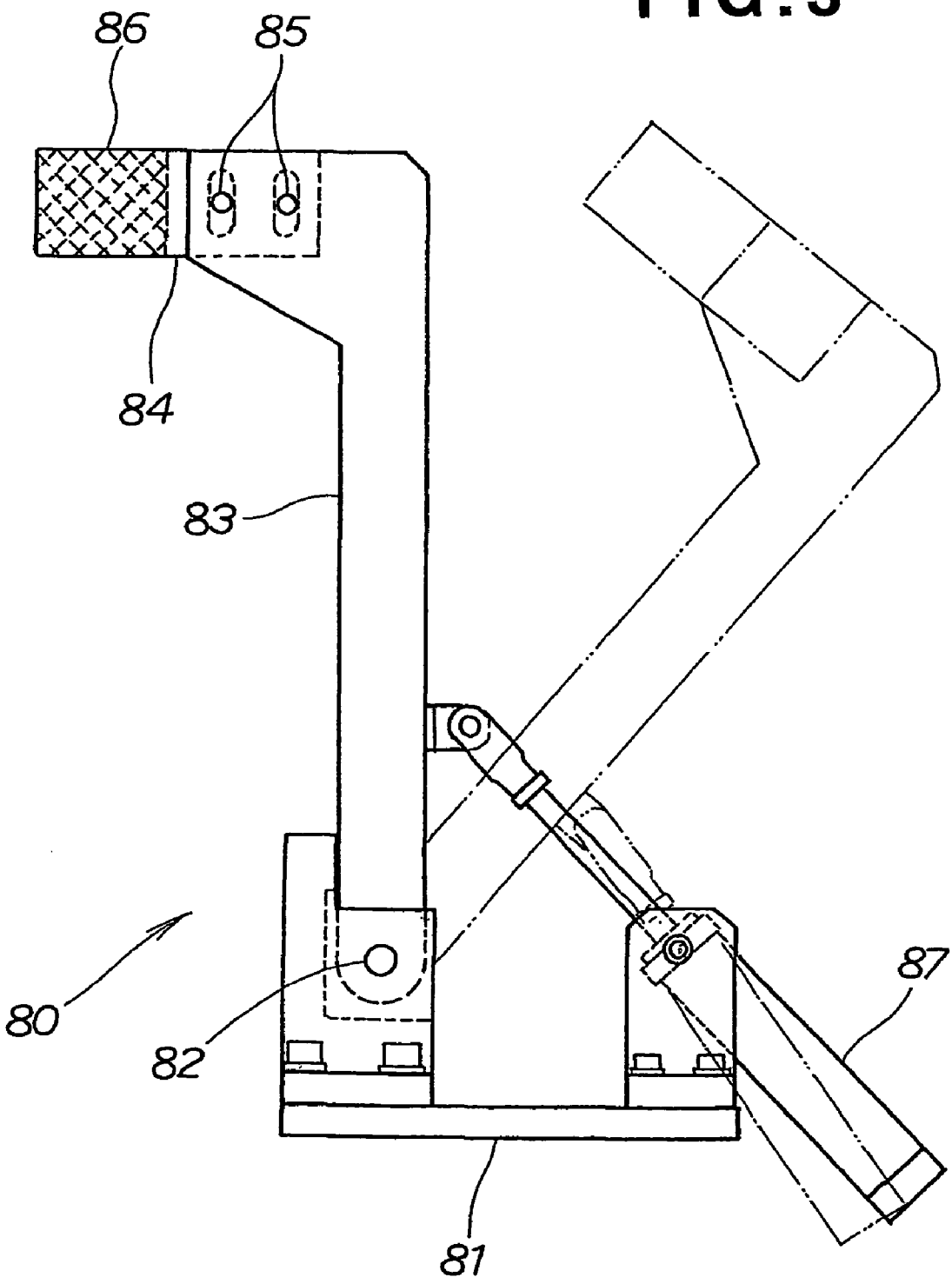
FIG. 3 is a view of the edge bending apparatus seen in a direction of arrow "3" of FIG. 2.

FIG. 3 is a view of the edge bending apparatus 10 seen in a direction of arrow "3" of FIG. 2. Each of the workpiece stopper 80 in the crossing gate shape includes an L-shaped arm 83 that is pivotally connected via a pin 82 to a base 81, and a retaining plate 84 fastened via bolts 85 to the distal end of the L-shaped arm 83; a resilient plate 86, such as a rubber plate, is secured to the distal end of the retaining plate 84. The L-shaped arm 83 is reciprocatively pivotable, via a cylinder 87 mounted on the base 81, between a solid-line position and an imaginary-line position.

The imaginary lines in FIG. 3 denote a standby position where the workpiece stopper 80 does not hinder horizontal movement of the workpiece, while the solid lines denote a stopping position where the workpiece stopper 80 abuts against the workpiece and thereby blocks the horizontal movement of the workpiece.

Referring back to FIG. 2, as the not-shown workpiece is transferred horizontally to the first workpiece transfer section 40 via the front workpiece transfer section 70, the workpiece comes into contact with the resilient plate 86 of the workpiece stopper 80 so that it can be positioned at a predetermined place.

Similarly, as the workpiece is transferred horizontally to the second workpiece transfer section 50 via the intermediate workpiece transfer section 60, the workpiece comes into contact with the resilient plate 86 of the workpiece stopper 80 so that it can be positioned at a predetermined place.

Figure 4:
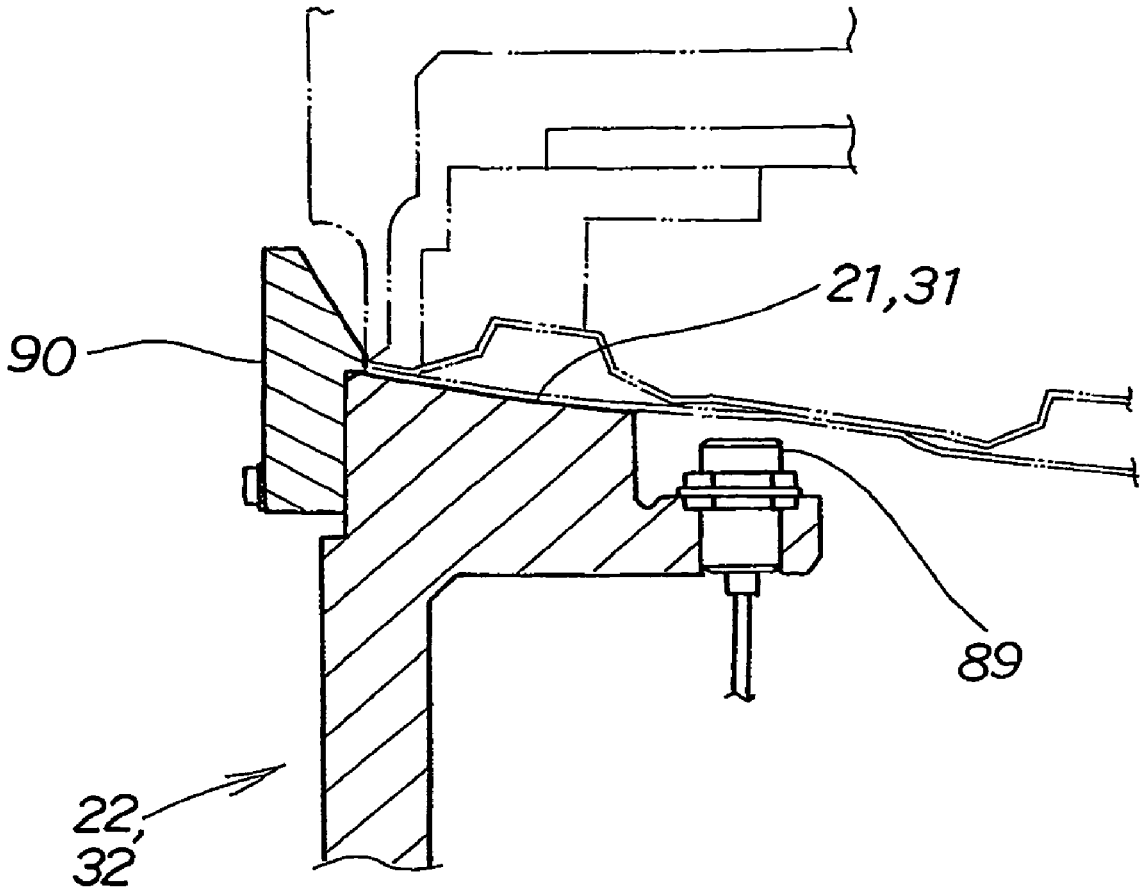
FIG. 4 is a view of the edge bending apparatus seen in a direction of arrow "4" of FIG. 2.

FIG. 4 is a view of the edge bending apparatus 10 seen in a direction of arrow "4" of FIG. 2. As shown, each of the workpiece detecting sensors 89, specifically in the form of a proximity switch or opto-electronic switch, is provided, near the corresponding peripheral support surface 21 or 31, for detecting presence/absence of a workpiece denoted in imaginary line.

Reference numeral 90 represents upper mold guiding pieces that are provided around the outer periphery of the first and second lower molds 22 and 32 as appropriate.

Figure 5:
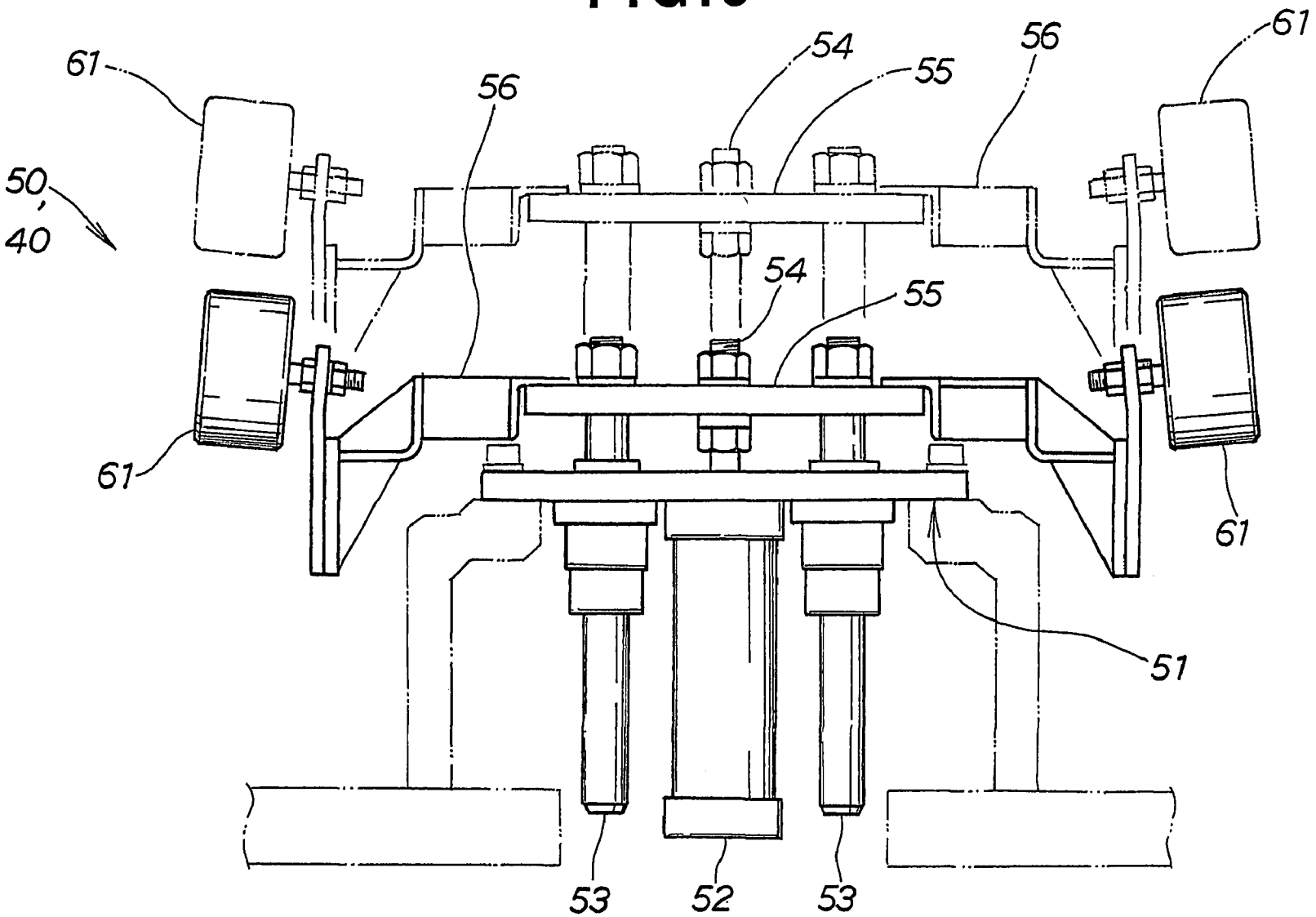
FIG. 5 is a view of the edge bending apparatus seen in a direction of a 5—5 arrow of FIG. 2.

FIG. 5 is a view of the edge bending apparatus 10 seen in a direction of the 5—5 arrow of FIG. 2. As shown, the second workpiece transfer section 50 includes a base plate 51, a lifting/lowering cylinder 52 connected to the base plate 51, and guide bars 53 provided, along opposite sides of the lifting/lowering cylinder 52, for sliding movement through the base plate 51. The second workpiece transfer section 50 also includes a lifting/lowering plate 55 connected to a piston rod 54 of the cylinder 52, a frame member 56 coupled to the lifting/lowering plate 55, and rollers 61 attached to the frame 56. As shown in FIG. 2, the frame 56 has a rectangular shape, and a plurality of rollers 61 (in the illustrated example, a total of eight rollers 61, four on each of the left and right sides) are attached to the frame 56, so as to provide a greater workpiece-carrying area.

The first workpiece transfer section 40 is constructed in the same manner as the second workpiece transfer section 50, and thus the construction of the first workpiece transfer section 40 will not be described in detail here to avoid unnecessary duplication.

Referring back to FIG. 5, the lifting/lowering plate 55, frame 56 and rollers 61 can be together raised to the position denoted by imaginary lines. Namely, the imaginary-line position is a lifted-up position of these elements, while the solid-line position is a standby position of these elements.

Next, a description will be made about behavior of the edge bending apparatus 10 arranged in the above-described manner.

Figure 6:
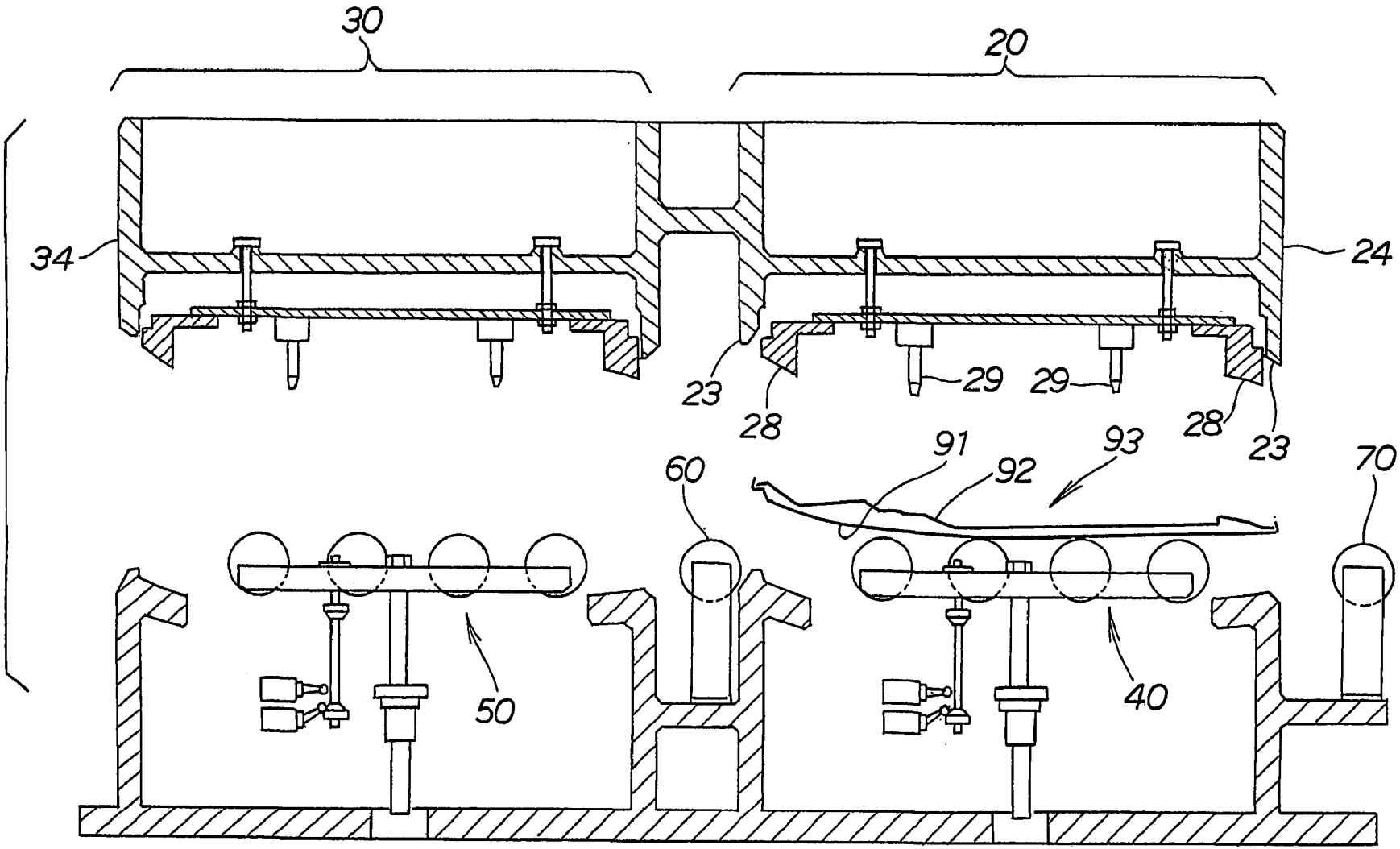
FIG. 6 is a view explanatory of a first sequence of operations performed by the edge bending apparatus of the present invention.

FIG. 6 is a view explanatory of a first or initial sequence of operations performed by the edge bending apparatus of the present invention. First workpiece 93, comprising a skin member 91 and stiffener member 92, is transferred horizontally to the first hemming mold unit 20 via the front workpiece transfer section 70 and first workpiece transfer section 40 while the first and second upper molds 24 and 34 are held in the upper standby position.

Figure 7:
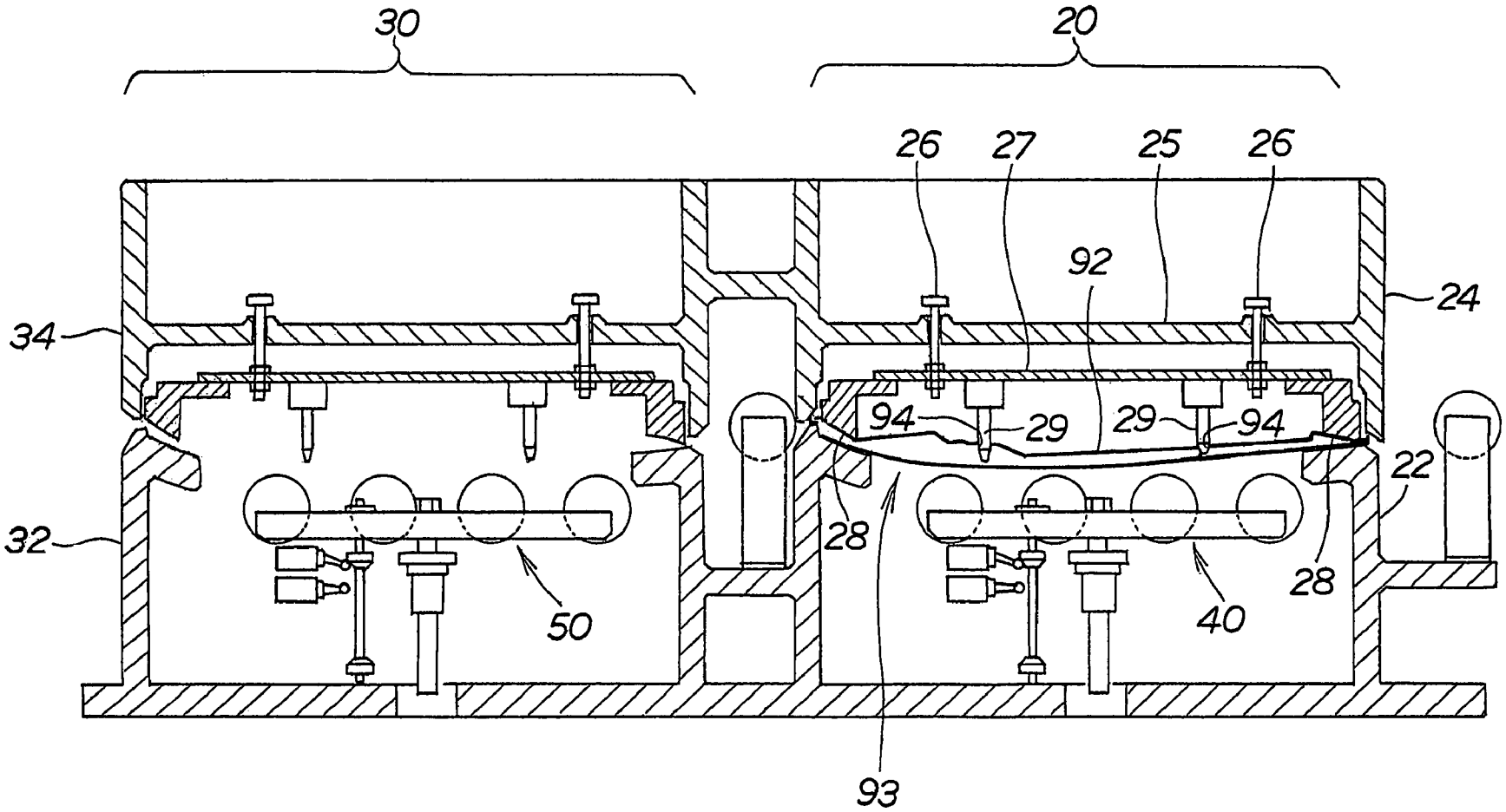
FIG. 7 is a view explanatory of a second sequence of operations performed by the edge bending apparatus of the present invention.

FIG. 7 is a view explanatory of a second sequence of operations performed by the edge bending apparatus of the present invention. Here, the first and second workpiece transfer sections 40 and 50 are lowered to the standby position, so that the first workpiece 93 is placed on the first lower mold 22.

After that, the first and second upper molds 24 and 34 are lowered to a predetermined position (slightly above a bottom dead center). Thus, the positioning pins 29 extending from the hanging frame 27 fit into positioning holes 94 of the stiffener member 92, so that the stiffener member 92 can be positioned at a predetermined place. Immediately after that, the workpiece retainers 28 retain the stiffener member 92.

In this state, the first and second upper molds 24 and 34 are lowered further. Although the hanging frame 27 can not be lowered any further at this time, the downward movement of the first and second upper molds 24 and 34 is never hindered because the bolts 26 extend through the cross beam 25.

Figure 8:
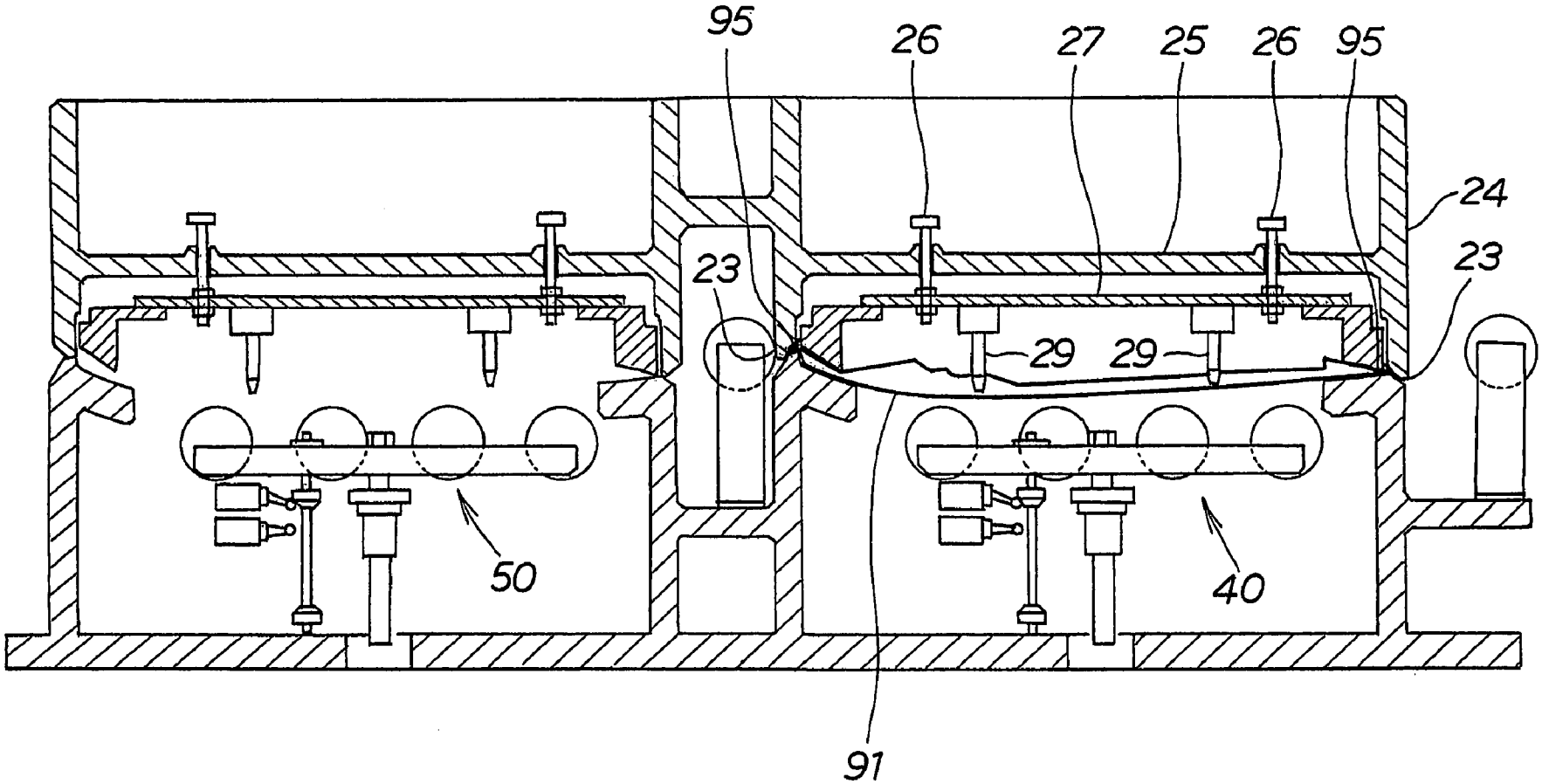
FIG. 8 is a view explanatory of a third sequence of operations performed by the edge bending apparatus of the present invention.

FIG. 8 is a view explanatory of a third sequence of operations performed by the edge bending apparatus of the present invention. Here, edges 95 of the skin member 91 are both bent about half of the predetermined full bending angle by means of the bending blades 23 of the first upper mold 24;

this partial bending of the edges will be later detailed in relation to a next figure. Note that the operational sequences of FIGS. 6 to 8 may be carried out in a successive manner with no substantial intervening break.

Figure 9:
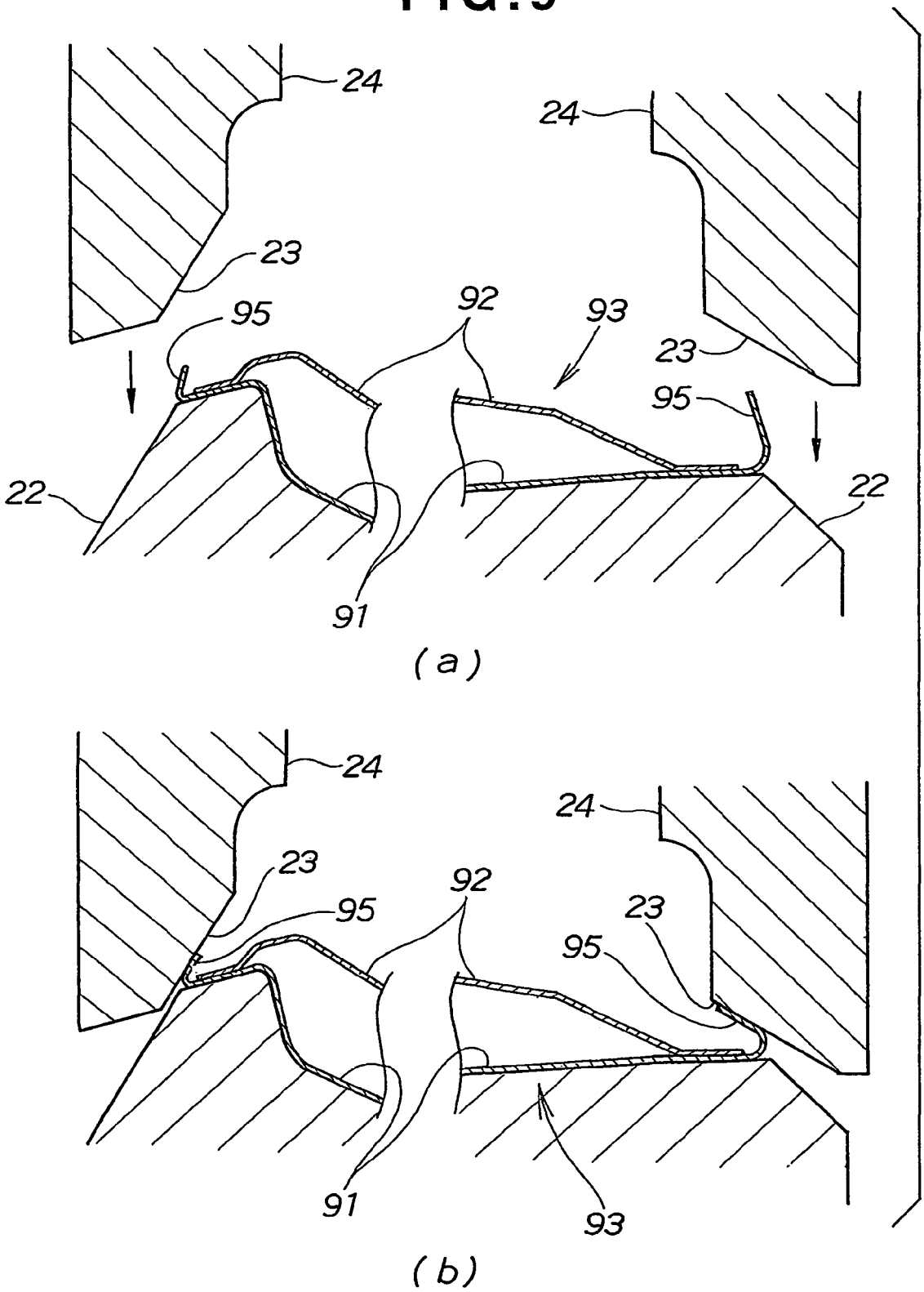
FIG. 9 is a view explanatory of how a first hemming mold unit of the invention works.

(a) and (b) of FIG. 9 are views explanatory of how the first hemming mold unit works in the present invention.

As shown in (a), the first upper mold 24 is lowered toward the first work piece 93 currently placed on the first lower mold 22; note that the edges 95 of the first work piece 93 has already been bent about 90 degrees in the previous step.

Then, as shown in (b), the edges 95 of the first work piece 93 is further bent to about half the predetermined full bending angle via the bending blades 23 as the first upper mold 24 is lowered toward the first work piece 93.

Figure 10:
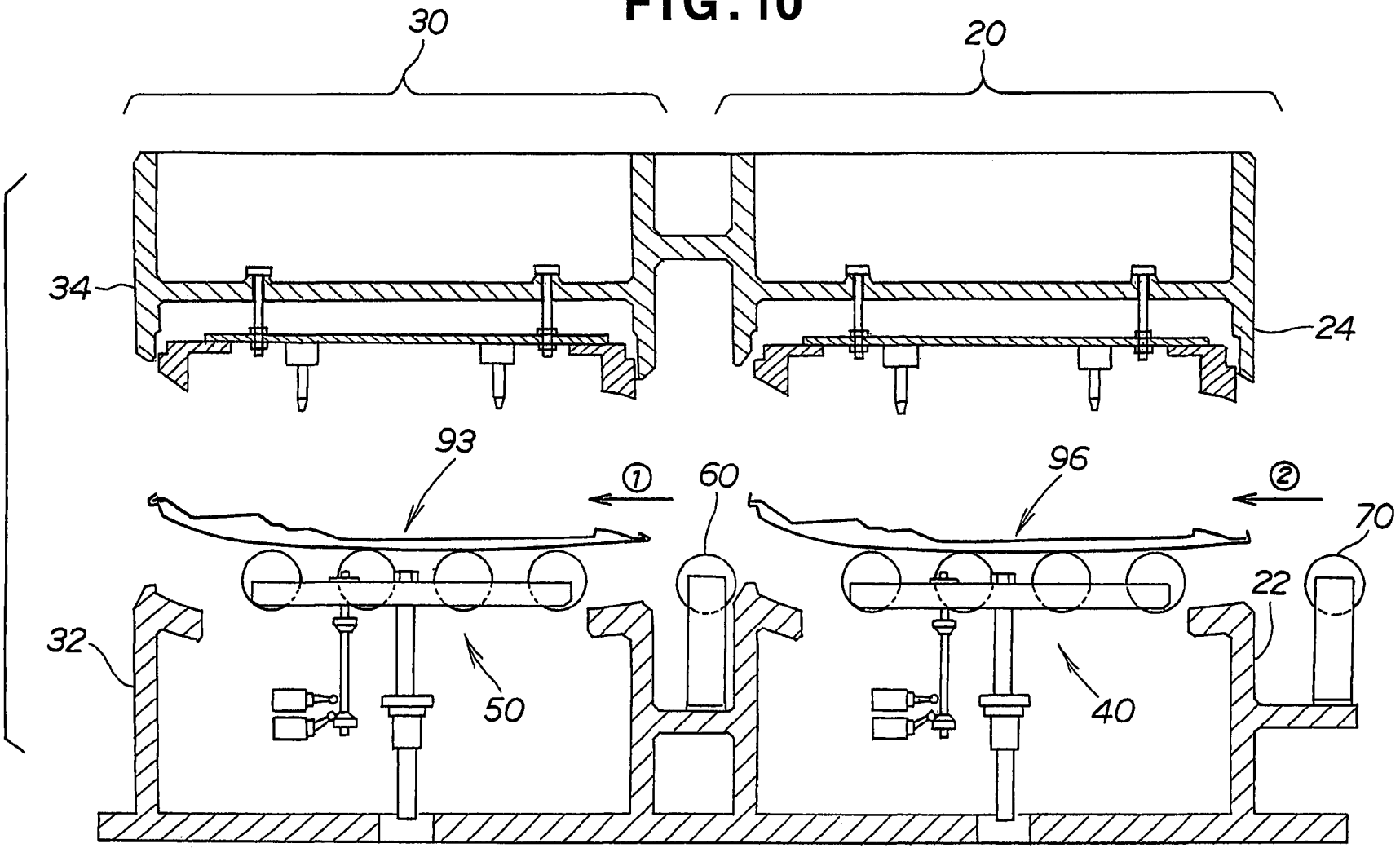
FIG. 10 is a view explanatory of a fourth sequence of operations performed by the edge bending apparatus of the present invention.

FIG. 10 is a view explanatory of a fourth sequence of operations performed by the edge bending apparatus of the present invention. The first workpiece 93, having so far been located below the first upper mold 24, is transferred horizontally to below the second upper mold 34 as indicated by arrow ① while the first and second upper molds 24 and 34 are held in the upper standby position. At this time, the horizontal transfer of the first workpiece 93 is greatly facilitated by the rollers 61 of the first workpiece transfer section lifted up to the upper level position, intermediate workpiece transfer section 60 and second workpiece transfer section also lifted up to the upper level position.

Now that the space below the first upper mold 24 has been emptied, a next or second workpiece 96 (which is of exactly the same type as the first workpiece 93 but referred to here by a different name just for convenience of description) is transferred to below the first upper mold 24 as indicated by arrow ② by means of the front workpiece transfer section 70 and first workpiece transfer section 40.

Namely, by this time, the first workpiece 93 has been appropriately set in the second hemming mold unit 30, and the second workpiece 96 has been appropriately set in the first hemming mold unit 20.

Figure 11:
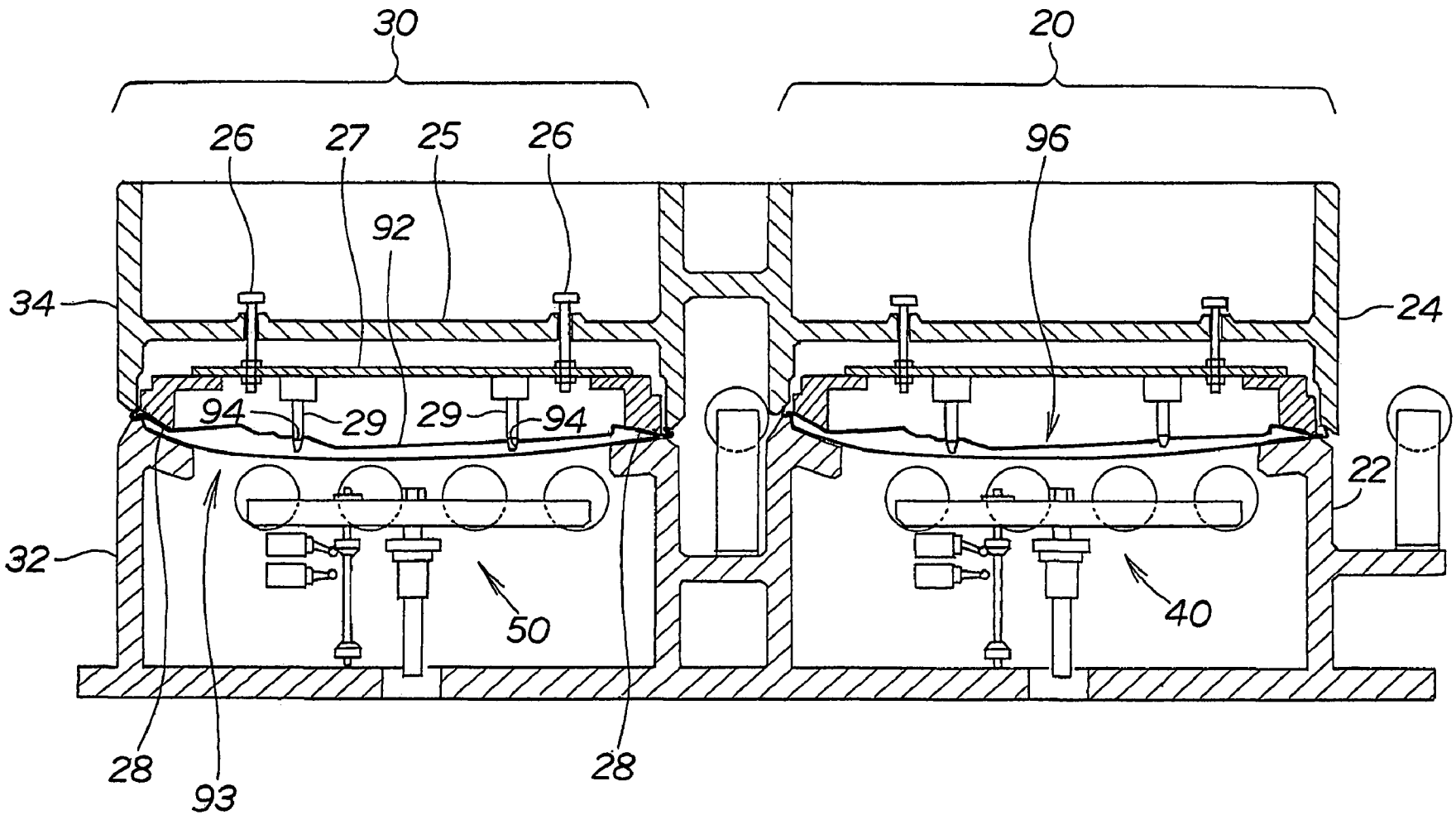
FIG. 11 is a view explanatory of a fifth sequence of operations performed by the edge bending apparatus of the present invention.

FIG. 11 is a view explanatory of a fifth sequence of operations performed by the edge bending apparatus of the present invention. Here, the first and second workpiece transfer sections 40 and 50 are lowered to the standby position, so that the first workpiece 93 is placed on the second lower mold 32 and the second workpiece 96 is placed on the first lower mold 22.

After that, the first and second upper molds 24 and 34 are lowered to a predetermined position (slightly above a bottom dead center). Thus, the positioning pins 29 extending from the hanging frame 27 fit into positioning holes 94 of the stiffener member 92, so that the stiffener member 92 can be positioned at a predetermined place. Immediately after that, the workpiece retainers 28 retain the stiffener member 92.

In this state, the first and second upper molds 24 and 34 are lowered further. Although the hanging frame 27 is not lowered any further at this time, the downward movement of the first and second upper molds 24 and 34 is never hindered because the bolts 26 extend through the cross beam 25.

Figure 12:
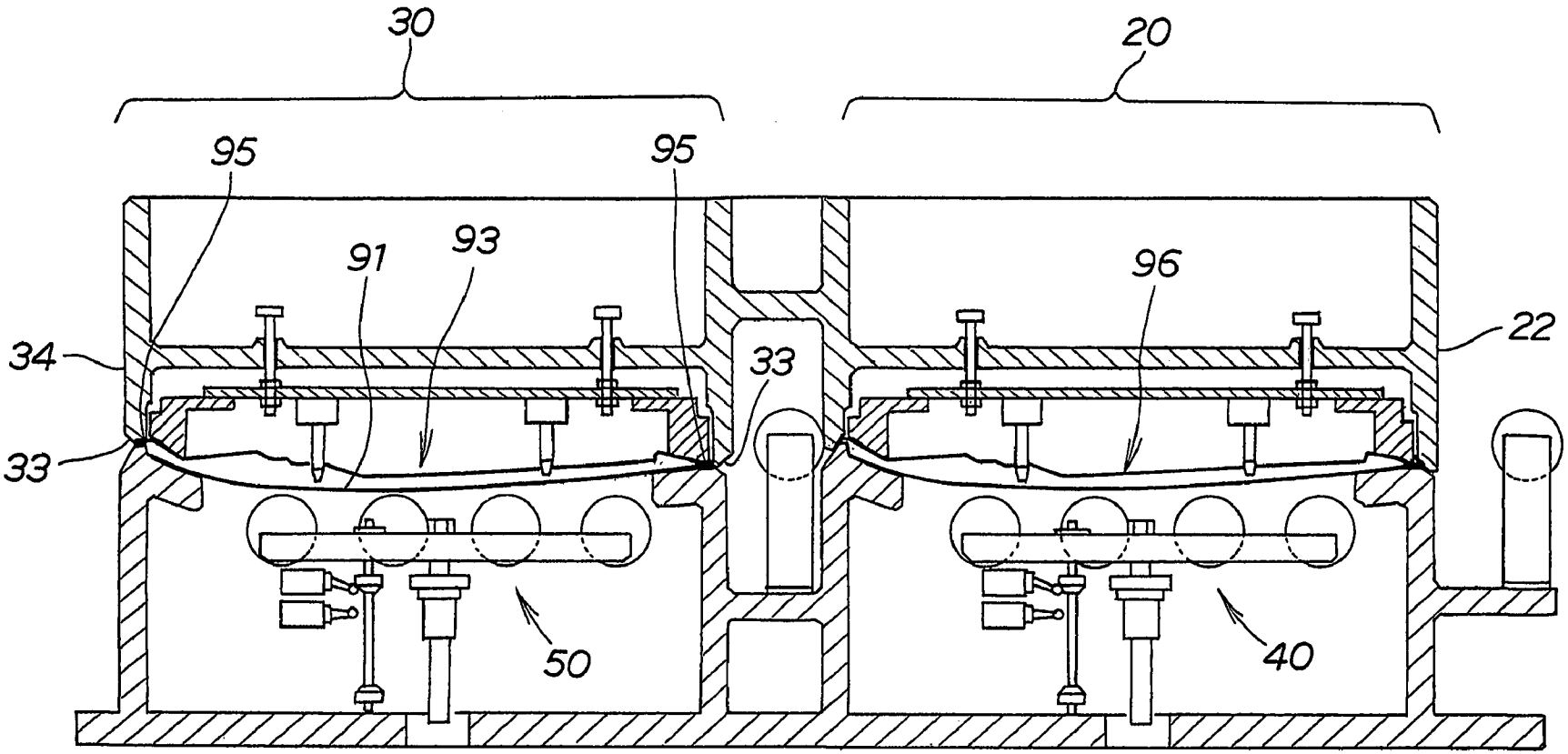
FIG. 12 is a view explanatory of a sixth sequence of operations performed by the edge bending apparatus of the present invention.

FIG. 12 is a view explanatory of a sixth sequence of operations performed by the edge bending apparatus of the present invention. Here, the edges 95 of the skin member 91 are further bent to the predetermined full angle via the bending blades 33 of the second upper mold 34. This complete bending of the edges 95 will be later detailed in relation to a next figure. Note that the operational sequences of FIGS. 10 to 12 may be carried out in a successive manner with no substantial intervening break.

In parallel with the bending of the edges 95 by the bending blades 33 of the second upper mold 34, the first hemming mold 20 performs preliminary bending of the second workpiece 96 in the same manner as already described earlier in relation to FIGS. 6 to 8.

Figure 13:
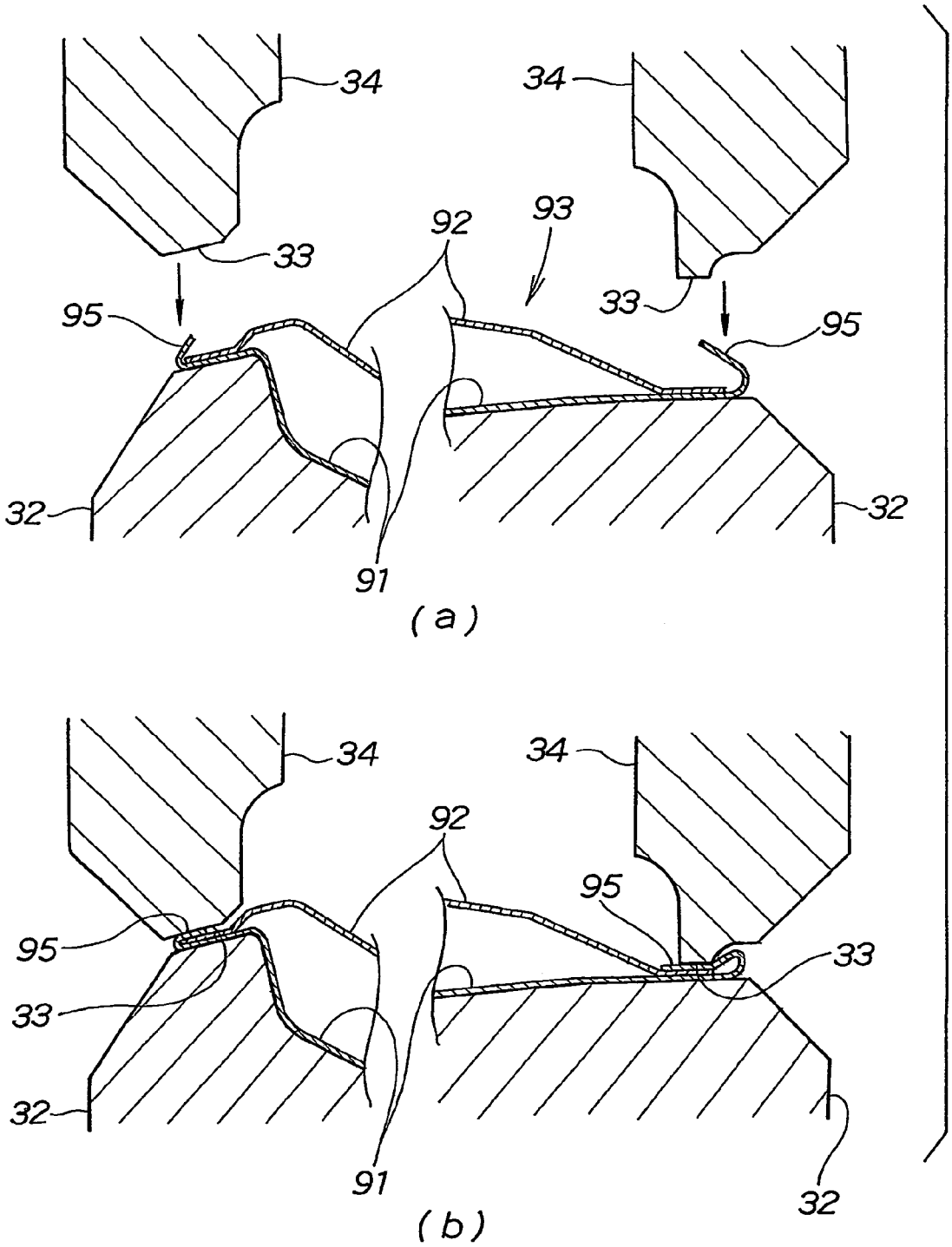
FIG. 13 is a view explanatory of how a second hemming mold unit of the invention works.
Figure 14:
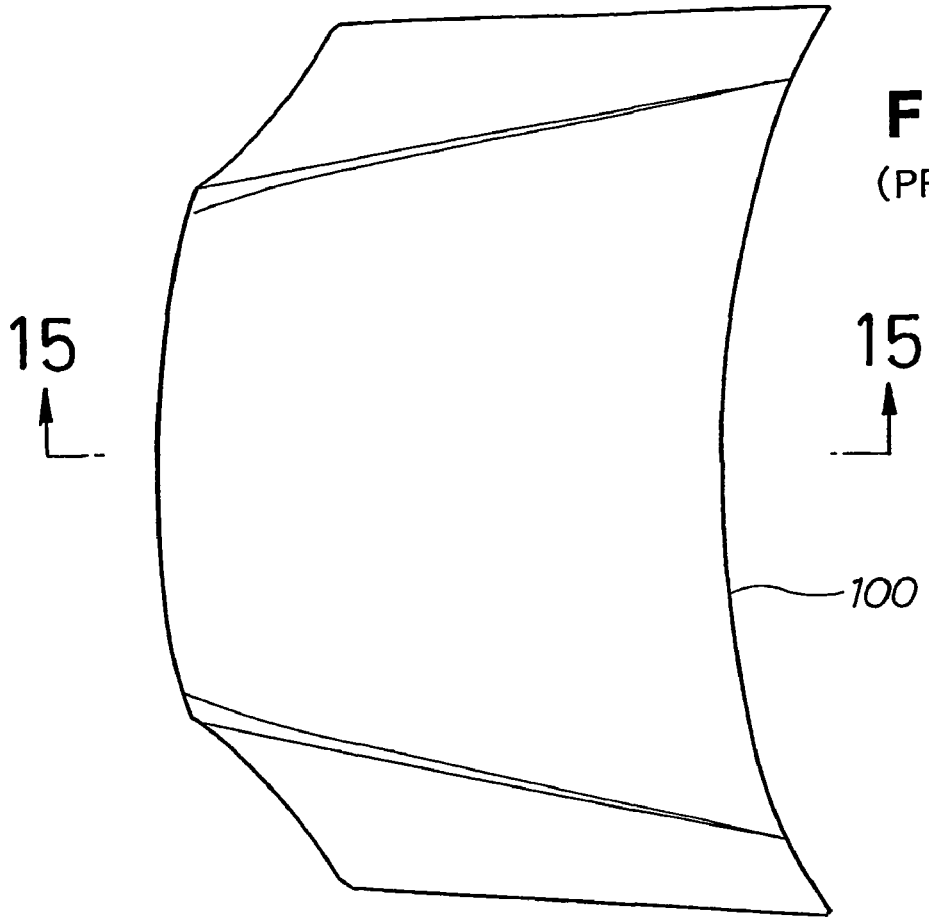
FIG.14 (PRIOR ART)
FIG. 14 is a plan view of a hood.
Figure 15:
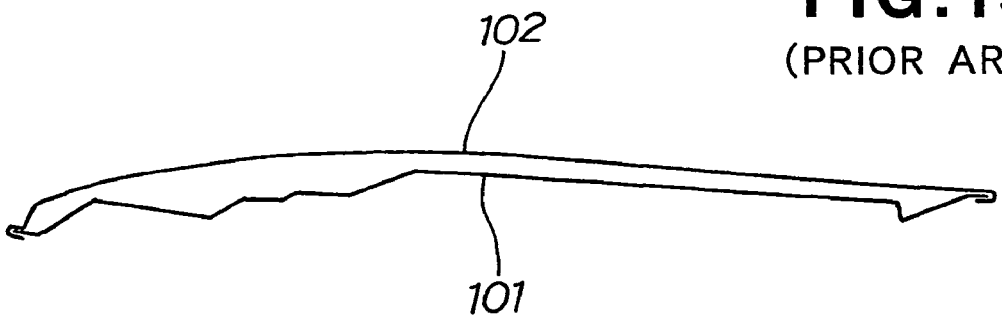
FIG.15 (PRIOR ART)
FIG. 15 is a sectional view of the hood taken along line 15—15 of FIG. 14.
Figure 16:
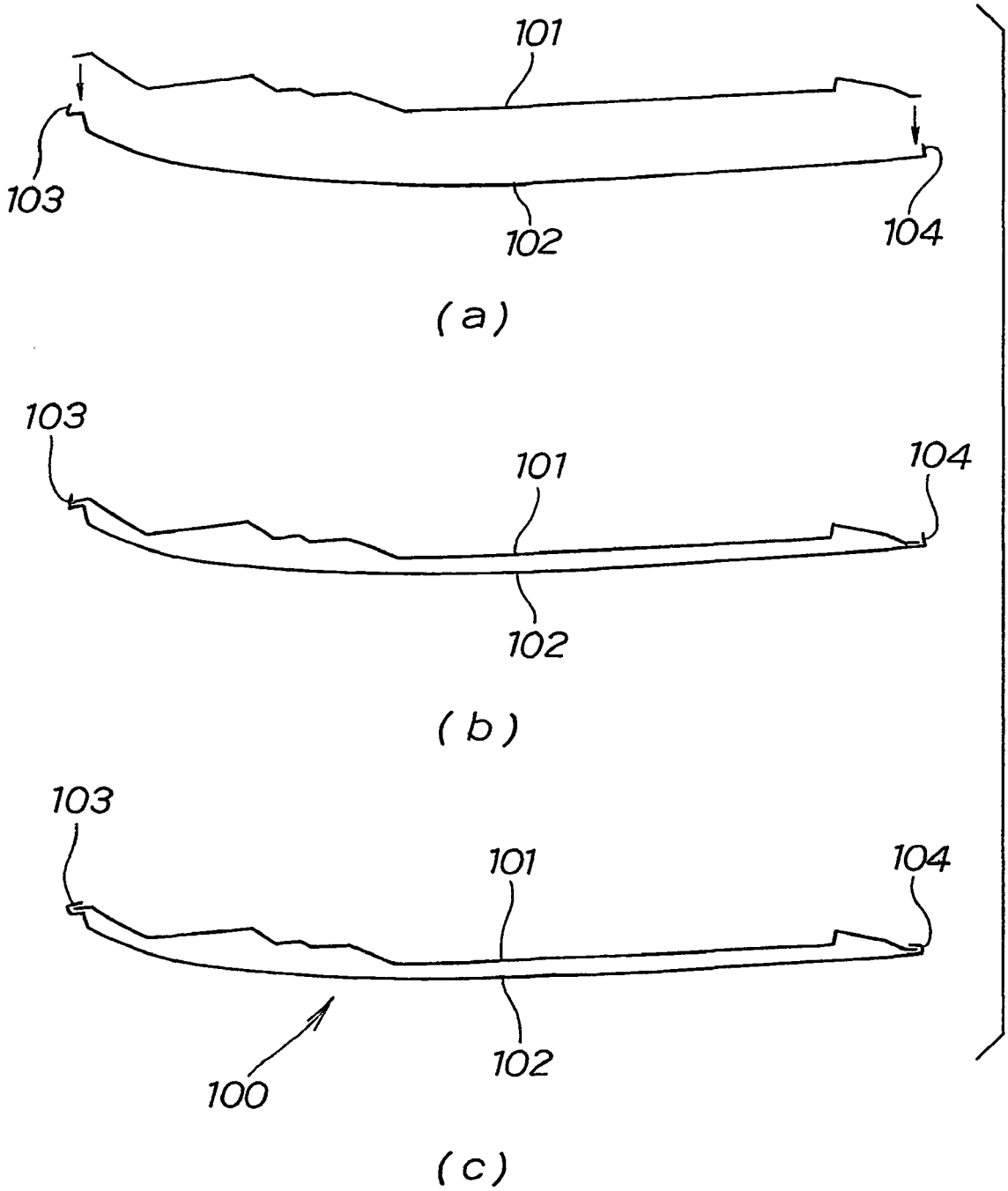
FIG. 16 (PRIOR ART)
FIG. 16 is a view explanatory of a conventionally-known method for manufacturing the hood.

(a) and (b) of FIG. 13 are views explanatory of how the second hemming mold unit works in the present invention.

As shown in (a), the second upper mold 34 is lowered toward the first work piece 93 currently placed on the second lower mold 32.

Then, as shown in (b), the edges 95 of the first work piece 93 is further bent to the predetermined full bending angle via the bending blades 33 as the second upper mold 34 is lowered toward the first work piece 93.

It should be obvious that the workpieces 93, 96 can be completely bent at their edges, i.e. hemmed, in a successive fashion by repeating the operation sequences of FIGS. 10–12. Namely, in the present invention, a plurality of hemming mold units, including at least the above-described first and second hemming mold units 20 and 30, are installed in a single pressing machine (not shown), a workpiece 93, 96 is subjected to partial (preliminary) edge-bending or hemming by the first hemming mold unit 20, the workpiece having thus been partially bent is transferred to the second hemming mold unit 30, and then the workpiece are subjected to the remaining hemming by the second hemming mold unit 30 to ultimately assume the full bending angle; that is, the present invention is characterized by completing the necessary hemming of the workpiece within the single pressing machine.

According to the edge bending method of the present invention, the workpiece is placed directly on the upper molds with no intervening cam and cam driver. Thus, there is no need to worry about occurrence of undue looseness or play, and it is possible to maintain a good finishing accuracy of products over a long period of time. In addition, because no intervening cam and cam driver is employed, the present invention accomplishes the superior advantageous result that the edge bending apparatus can be greatly simplified in construction.

Further, in the present invention, a so-called robot may be used to feed a workpiece to the first hemming mold unit and horizontally transfer the workpiece from the first hemming mold unit to the second hemming mold unit. However, in the edge bending apparatus provided with the first, second and intermediate workpiece transfer sections as described above, the workpiece can be fed to the first hemming mold unit and transferred from the first hemming mold unit to the second first hemming mold unit without requiring use of such an expensive robot. As a consequence, costs of the edge bending apparatus can be reduced to a considerable degree.

Further, although the first, second and intermediate workpiece transfer sections may be driven using a motor or cylinder as a driving source to horizontally transfer the workpiece, the present invention is arranged to horizontally transfer the workpiece by placing the workpiece on the rollers, provided to project above the upper surface of the workpiece transfer sections, so that the workpiece can be easily transferred on the rollers manually by a human operator. Thus, the first, second and intermediate workpiece transfer sections can be considerably reduced in size and cost.

Whereas the embodiment of the present invention has been described as installing two hemming mold units in a single pressing machine, three or more hemming mold units may be installed in the pressing machine. If it is necessary for each of the hemming mold units to bend the workpiece by a reduced angle, the increased number of the hemming mold units will be more effective.

Although the embodiment has been described as connecting together the left and right upper or lower molds, separate molds may be mounted on a common board called a die set and this die set with the molds may be installed in the pressing machine.

Furthermore, any types of workpieces, such as a hood, trunk lid, door and sun roof, which require hemming may be handled by the present invention.

INDUSTRIAL APPLICABILITY

The inventive edge bending method can be employed in the manufacture of automobiles, particularly their hoods, and is useful in that it permits edge bending in a single pressing machine.

The invention claimed is:

1. An edge bending apparatus comprising:

a first hemming mold unit for bending an edge of a workpiece halfway through a predetermined full bending angle;

a second hemming mold unit for further bending the edge of the workpiece from the halfway angle to the predetermined full bending angle, said first hemming mold unit and said second hemming mold unit being installed in parallel in the same pressing machine;

a first workpiece transfer section movable upward and downward through a lower mold of said first hemming mold unit for placing a workpiece on said first hemming mold unit or feeding the workpiece to said first hemming mold unit;

a second workpiece transfer section movable upward and downward through a lower mold of said second hemming mold unit for placing the workpiece on said second hemming mold unit or feeding the workpiece to said second hemming mold unit; and an intermediate workpiece transfer section disposed between said first workpiece transfer section and said second workpiece transfer section for supporting thereon the workpiece to be transferred horizontally from said first workpiece transfer section to said second workpiece transfer section.

2. An edge bending apparatus as claimed in claim 1 wherein said first workpiece transfer section, said second workpiece transfer section and said intermediate workpiece transfer section each include rollers provided to project above an upper surface thereof in such a manner that the workpiece can be transferred horizontally on the rollers through manual operation by a human operator.

* * * * *